US010173878B2

(12) United States Patent
Peithman

(10) Patent No.: US 10,173,878 B2
(45) Date of Patent: Jan. 8, 2019

(54) HAND WASHING DISPENSER FOR A WATER BOTTLE

(71) Applicant: Kevin Peithman, Goodlettsville, TN (US)

(72) Inventor: Kevin Peithman, Goodlettsville, TN (US)

( * ) Notice: Subject to any disclaimer, the term of this patent is extended or adjusted under 35 U.S.C. 154(b) by 0 days.

(21) Appl. No.: 15/498,002

(22) Filed: Apr. 26, 2017

(65) Prior Publication Data

US 2018/0312388 A1 Nov. 1, 2018

(51) Int. Cl.

| | |
|---|---|
| ***B67B 7/00*** | (2006.01) |
| ***B67D 3/00*** | (2006.01) |
| ***B65D 47/24*** | (2006.01) |
| *A47K 7/00* | (2006.01) |

(52) U.S. Cl.

CPC ..... *B67B 7/26* (2013.01); *B65D 47/248* (2013.01); *B67D 3/0032* (2013.01); *B67D 3/0064* (2013.01); *A47K 7/00* (2013.01)

(58) Field of Classification Search

CPC ..... B67D 3/0061; B67D 3/04; B67D 3/043; B67D 3/047; B65D 5/747; B65D 5/748; B65D 5/749; B65D 17/00; B65D 17/02; B65D 17/42; B65D 17/44; B65D 47/36; B65D 47/38; B65D 77/067; B65D 47/248; A45F 3/16; B67B 7/24; B67B 7/26; B67B 7/28; B67B 7/44

USPC ..... 222/80–91, 180–181.3, 185.1

See application file for complete search history.

(56) References Cited

U.S. PATENT DOCUMENTS

| | | | | | |
|---|---|---|---|---|---|
| 105,818 | A | * | 7/1870 | Lord | 222/91 |
| 183,445 | A | * | 10/1876 | Bentley | 222/81 |
| 354,150 | A | * | 12/1886 | Jones | 222/91 |
| 477,308 | A | * | 6/1892 | McFarland | 222/91 |
| 503,666 | A | * | 8/1893 | Mott | B67B 7/26 222/90 |
| 549,305 | A | * | 11/1895 | Barnes | B67B 7/26 222/90 |
| 552,408 | A | * | 12/1895 | Barnes | B67B 7/26 222/90 |
| 766,083 | A | * | 7/1904 | Watts | B67B 7/26 222/542 |
| 1,145,778 | A | * | 7/1915 | McCrystle | B67B 7/26 220/212 |
| 1,618,720 | A | * | 2/1927 | Moore | B67B 7/26 222/91 |
| 1,680,876 | A | * | 8/1928 | Guerris | B65D 47/242 222/91 |
| 3,333,737 | A | * | 8/1967 | Molineux | B67B 7/26 222/91 |

(Continued)

*Primary Examiner* — Patrick M. Buechner

(74) *Attorney, Agent, or Firm* — RG Patent Consulting, LLC; Rachel Gilboy

(57) ABSTRACT

A dispenser is provided for dispensing liquid from a standardized container (e.g., a water bottle). A gravity based dispenser for use with a bottle of liquid (e.g., water bottle) hangs about the neck of a user and allows the user to selectively dispense water from the water bottle while the user maintains a valve of the dispenser in an open position. In a closed position, the valve of the dispenser prevents the flow of liquid from the bottle to which the dispenser is attached. The valve is biased to the closed position. In this way, a user may use water to wash their hands using a single water bottle without using unnecessary quantities of water.

7 Claims, 7 Drawing Sheets

(56) References Cited

U.S. PATENT DOCUMENTS

| | | | | | |
|---|---|---|---|---|---|
| 4,440,316 | A * | 4/1984 | Christine | B65D 47/248 | 222/183 |
| 5,141,133 | A * | 8/1992 | Ninomiya | B65D 5/748 | 222/541.2 |
| 5,147,070 | A * | 9/1992 | Iwamoto | B65D 5/748 | 222/541.2 |
| 5,228,592 | A * | 7/1993 | Pellerano | B65D 47/36 | 222/83 |
| 5,297,696 | A * | 3/1994 | Bernstein | B67B 7/26 | 222/83 |
| 5,325,983 | A * | 7/1994 | Imai | B65D 5/748 | 220/277 |
| 5,482,176 | A * | 1/1996 | Maietta | B65D 5/748 | 215/220 |
| 5,549,389 | A * | 8/1996 | Takagaki | B65D 75/5877 | 215/255 |
| 5,884,810 | A * | 3/1999 | Vizcarra | B65D 47/38 | 222/83 |
| 6,427,872 | B1 * | 8/2002 | Anderson | B65B 55/022 | 222/541.2 |
| 2005/0017022 | A1 * | 1/2005 | Faygenov | B67B 7/24 | 222/83.5 |
| 2006/0027601 | A1 * | 2/2006 | Zorzo | B65D 47/24 | 222/181.2 |
| 2013/0270293 | A1 * | 10/2013 | Dresser | B65D 5/748 | 222/83 |

* cited by examiner

HAND WASHING DISPENSER FOR A WATER BOTTLE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to hygiene and handwashing in remote areas and areas affected by natural disasters. More particularly, this invention pertains to systems and methods for dispensing water (or another substance) from a bottle.

In many areas of the world, such as remote areas and areas affected by natural disasters, running water is not available. Examples of such areas include oil fields, campsites, and fishing boats, as well as cities and towns affected by floods, earthquakes, storms, and other natural or manmade disasters. In all of these scenarios, potable water is generally unavailable unless brought in. Such potable water is generally supplied in standardized 16-20 ounce bottles. Additionally, most of the approximately 100 million bottles of water used worldwide each day are used because the water locally available is not suitable for drinking or even cooking, cleaning, and other daily functions such as handwashing.

Current solutions for washing hands with bottled water include pouring the water into another, larger container with a spigot or attempting to pour water on each hand while washing, setting the bottle down to switch hands. Filling a larger container with a spigot requires the presence of that container, and a large amount of bottled water to fill it. Pouring water on each of your hands tends to result in excessive consumption of water. Therefore, antibacterial handwipes or antibacterial foams and gels are generally the best available solutions for washing your hands in areas without running potable water. However, handwipes are very ineffective at removing large amounts of dirt from your hands, which results in excessive usage of wipes and large amounts of trash. These same shortcomings apply to antibacterial foams and gels.

BRIEF SUMMARY OF THE INVENTION

Aspects of the present invention provide a system and method for dispensing liquid from a standardized container. More particularly, aspects of the present invention provide a gravity based dispenser for use with a bottle of liquid (e.g., water bottle). In some embodiments, the dispenser hangs about the neck of a user and allows the user to selectively dispense water from the water bottle while the user maintains a valve of the dispenser in an open position. In a closed position, the valve of the dispenser prevents the flow of liquid from the bottle to which the dispenser is attached. The valve is biased to the closed position. In this way, a user may use water to wash their hands using a single water bottle without using unnecessary quantities of water.

In one aspect, a gravity based dispenser for a bottle includes a nozzle, a tube, seal, a valve, and a dispenser housing. The nozzle is configured to dispense a liquid from the bottle when receiving the liquid from the bottle. The tube is configured to insert into the bottle through a hole in the bottle and receive liquid from the bottle. The seal surrounds the tube. The seals configured to engage the bottle and prevent liquid from flowing out of the bottle through the hole in any space between the tube and an edge of the hole. The valve is configured to selectively provide liquid from the tube to a nozzle while in an open position and prevent liquid from flowing from the tube to the nozzle when in the closed position. The dispenser housing supports the nozzle, tube, seal, and valve.

In another aspect, the gravity based dispenser for a bottle includes a nozzle, a tube, a seal, a valve, a dispenser housing, a wing, and a relief tube. The nozzle is configured to dispense a liquid from the bottle when receiving the liquid from the bottle. The tube is configured to insert into the bottle through a hole in the bottle and receive liquid from the bottle. The seal surrounds the tube. The seals configured to engage the bottle and prevent the liquid from flowing out of the bottle through the hole in any space between the tube and an edge of the hole. The valve is configured to selectively provide the liquid from the tube to the nozzle while in an open position and to prevent the liquid from flowing from the tube to the nozzle when in a closed position. The dispenser housing supports the nozzle, tube, seal, and valve. The wing is attached to the valve. The wing protrudes from the nozzle and is configured to move the valve from the closed position to the open position when the wing moves relative to the nozzle from a resting position of the wing. The relief tube extends from the valve into the bottle when the dispenser is installed on the bottle. The valve is biased the closed position such that the wing is biased to the resting position. The dispenser housing is integral with the nozzle. The seal comprises a series of flanges protruding radially from the tube. The series of flanges is configured to engage the bottle when a cap of the bottle is removed in the dispenser is installed on the bottle.

In another aspect, the gravity based dispenser for a bottle includes a nozzle, a tube, a seal, a valve, a dispenser housing, a gasket, a nozzle insert, and a nozzle. The nozzle is configured to dispense a liquid from the bottle when receiving the liquid from the bottle. The tube is configured to insert into the bottle through a hole in the bottle and receive liquid from the bottle. The seal surrounds the tube. The seals configured to engage the bottle and prevent the liquid from flowing out of the bottle through the hole in any space between the tube and an edge of the hole. The valve is configured to selectively provide the liquid from the tube to the nozzle while in an open position and to prevent the liquid from flowing from the tube to the nozzle when in a closed position. The dispenser housing supports the nozzle, tube, seal, and valve. The dispenser housing secures the dispenser to the bottle when the dispenser is installed on the bottle. The tube includes serrations on an end of the tube configured to insert into the bottle when the dispenser is installed on the bottle. The seal includes a gasket pressed against the bottle by the tube when the dispenser is installed on the bottle and the tube is inserted into the bottle. The spring configured to bias the tube toward the bottle when the dispenser is installed on the bottle. The nozzle insert is connected to the tube. The nozzle insert is configured to be rotatable by the user relative to the dispenser housing. The tube is configured to rotate with the nozzle insert such that the serrations of the to create the hole in the bottle as the tube and nozzle insert are rotated. The nozzle Engages the tube to create the valve. The nozzle opens the valve when rotated in a first direction and closes the valve when rotated in a second direction opposite the first direction.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
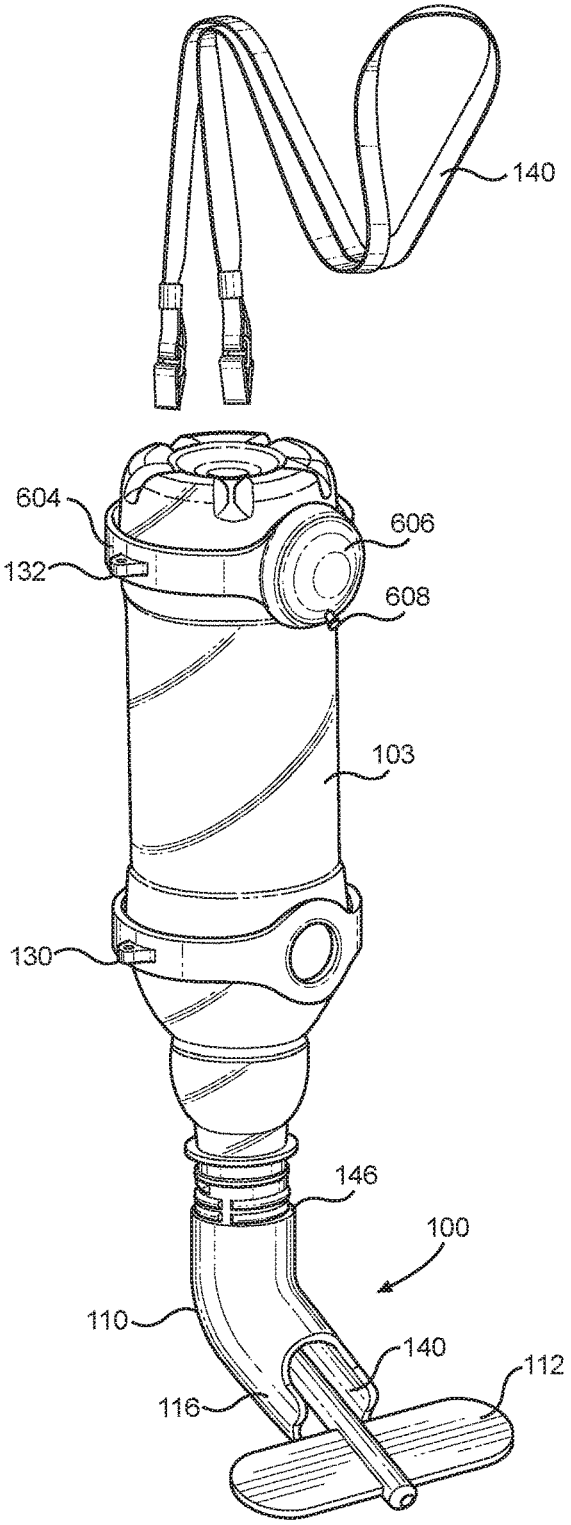
FIG. 1 is a front isometric view of a gravity based dispenser attached to a bottle of liquid.
Figure 3:
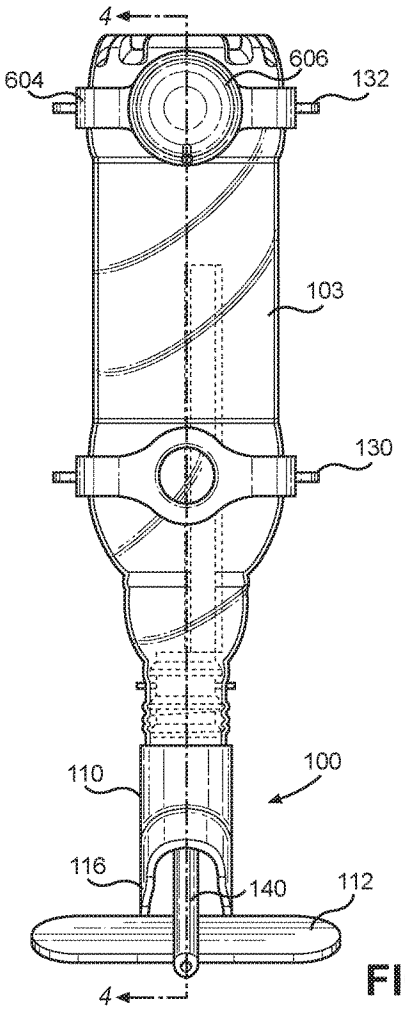
FIG. 3 is a front plan view of the dispenser and bottle of FIG. 1.
Figure 2:
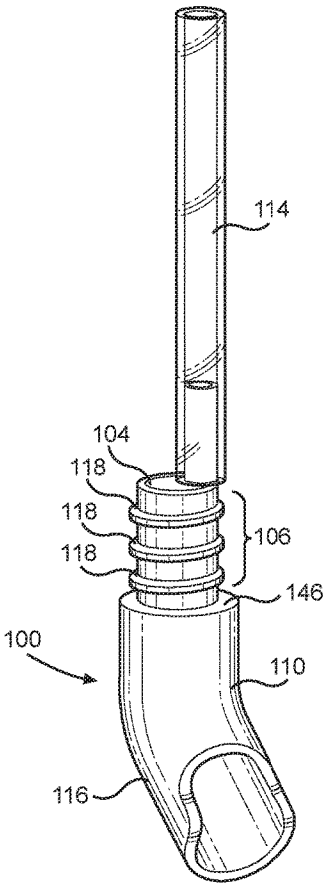
FIG. 2 is a front isometric view of a nozzle and relief tube of the dispenser of FIG. 1.
Figure 4:
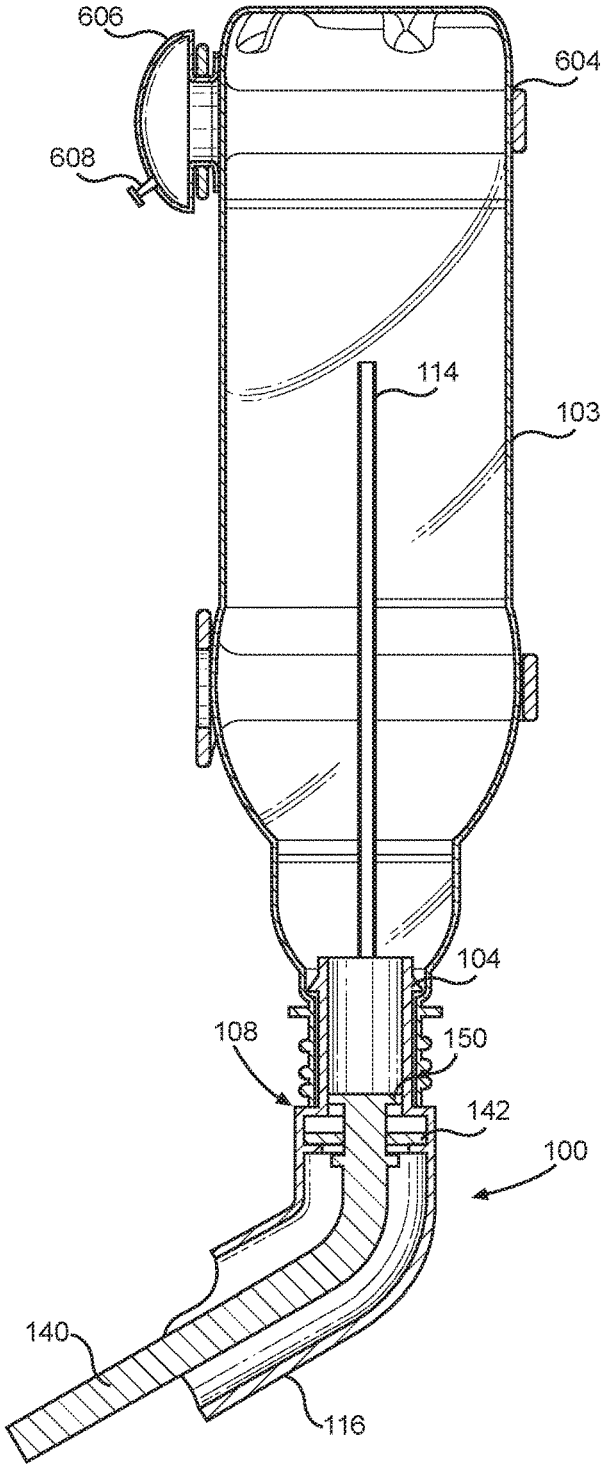
FIG. 4 is a side cutaway view of the dispenser and bottle of FIG. 1 taken along a center of the dispenser.
Figure 5:
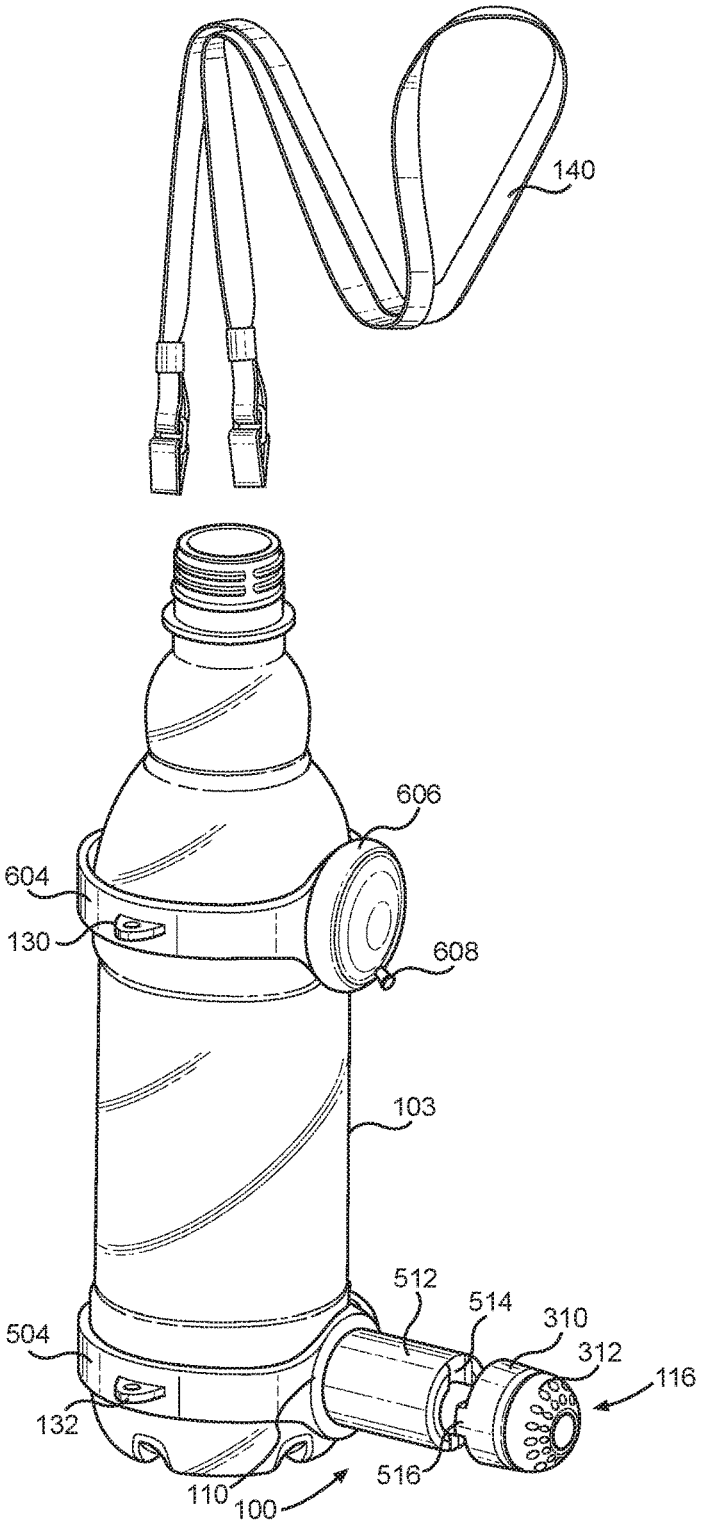
FIG. 5 is a front isometric view of a gravity based dispenser attached to a bottle of liquid.
Figure 7:
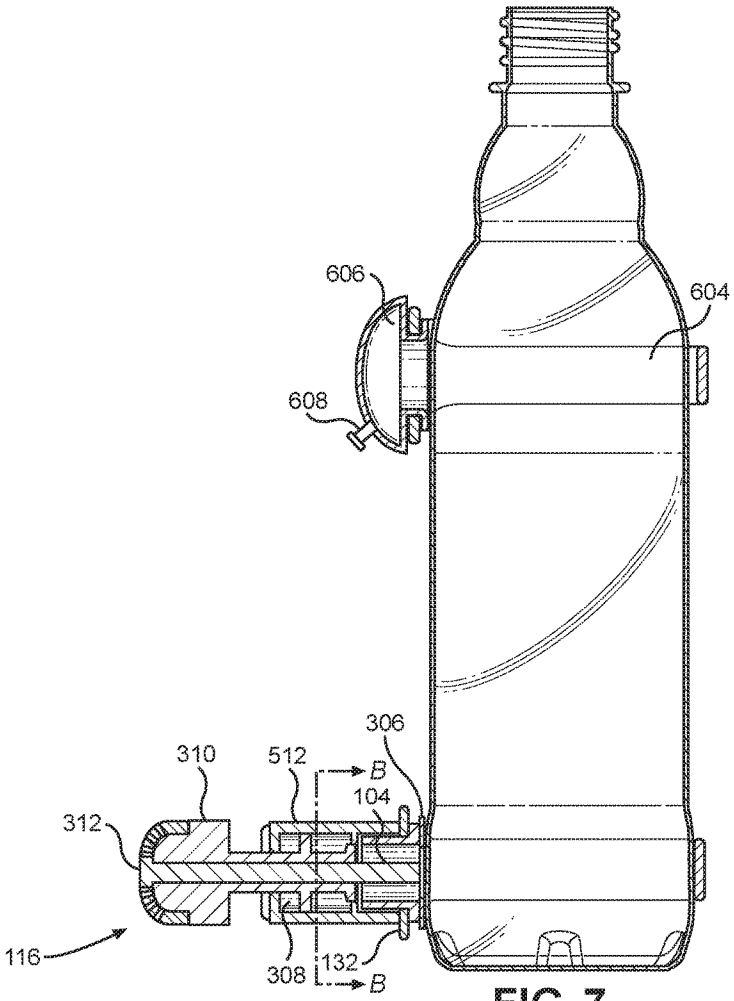
FIG. 7 is a side cutaway view along plane A of the dispenser and bottle of FIG. 6, showing plane B through the dispenser.
Figure 6:
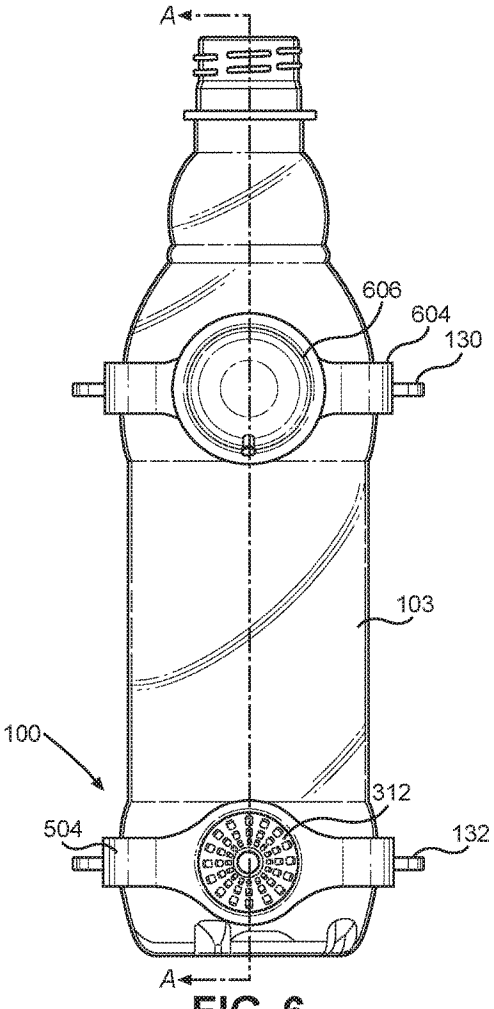
FIG. 6 is a front plan view of the dispenser and bottle of FIG. 5 showing a plane A through the dispenser.
Figure 9:
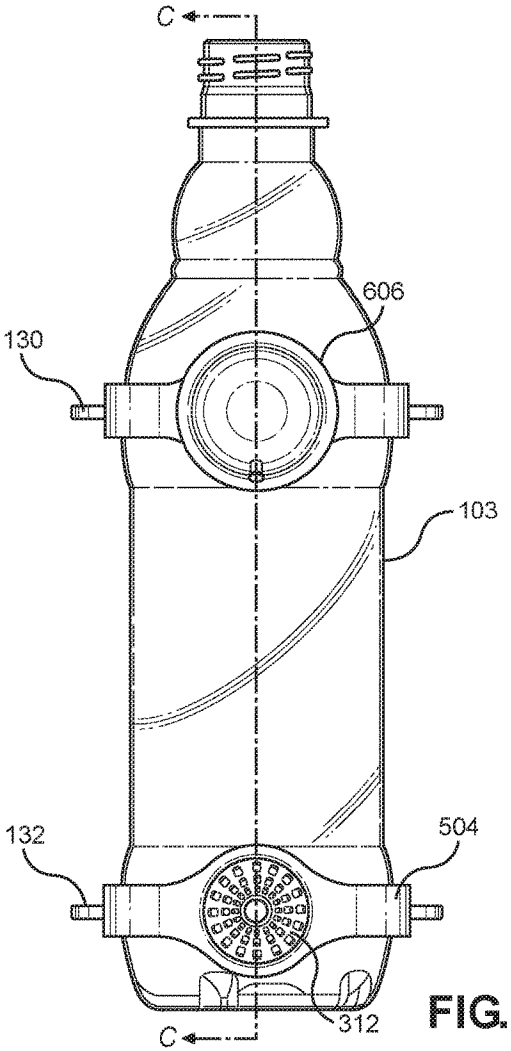
FIG. 9 is a front plan view of the dispenser and bottle of FIG. 5 showing a plane C.
Figure 8:
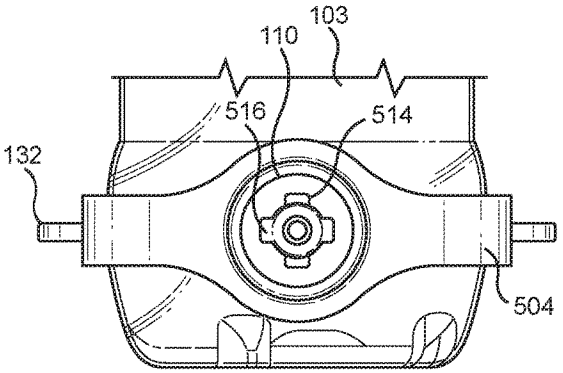
FIG. 8 is a front cutaway view of the dispenser and bottle of FIG. 5 taken through a valve of the dispenser along plane B.
Figure 10:
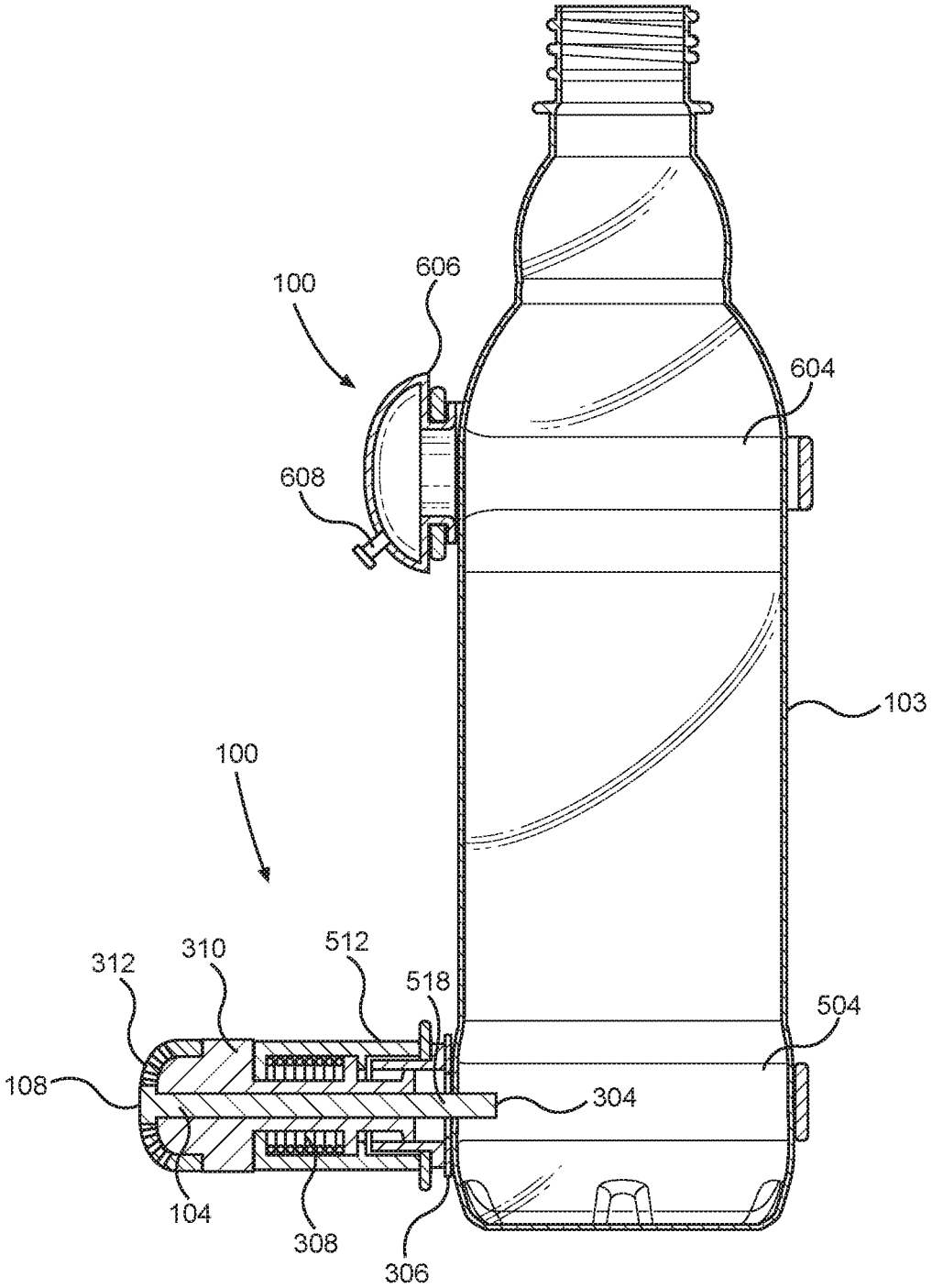
FIG. 10 is a side cutaway view of the dispenser and bottle of FIG. 9 along plane C.

As described herein, an upright position is considered to be the position of apparatus components while in proper operation or in a natural resting position as described herein. FIG. 1 shows a first embodiment of a dispenser in an upright position, and FIG. 5 shows a second embodiment of a dispenser in an upright position. Vertical, horizontal, above, below, side, top, bottom and other orientation terms are described with respect to this upright position during operation unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

In one embodiment, a gravity driven dispenser 100 for a water bottle 103 is provided. The dispenser includes a valve 108 biased to a closed position. The valve 108 releases water from the bottle 103 while held in an open position by a user. In this way, while hunting, fishing, camping, or during disaster relief, the user may periodically wash their hands with water while avoiding using an excess of water to do so.

In one embodiment, the gravity-based dispenser 100 for the bottle 103 includes a nozzle 116, a tube 104, a seal 106, a valve 108, and a dispenser housing 110. The nozzle 116 is configured to dispense liquid from the bottle 103 when receiving the liquid from the bottle 103. The tube 104 is configured to insert into the bottle 103 through a hole in the bottle 103 and receive the liquid from the bottle 103. The seal 106 surrounds the tube 104. The seal 106 is configured to engage the bottle 103 and prevent the liquid from flowing out of the bottle 103 through the hole in any space between the tube 104 and an edge of the hole. The valve 108 is configured to selectively provide liquid from the tube 104 to the nozzle 116 while in an open position and prevent the liquid from flowing from the tube 104 to the nozzle 116 when in a closed position. The dispenser housing 110 supports the nozzle 116, tube 104, seal 106, and valve 108.

Referring to FIGS. 1-4, a first embodiment of a gravity driven dispenser 100 for a bottle 103 of liquid is shown installed on a water bottle 103. A flexible ribbed or flanged plug inserts into the mouth 400 of the bottle 103 when a cap of the bottle 103 is removed to expose the mouth 400 of the bottle 103. The flexible flanges 118 may vary in size (e.g., smaller to larger) or be a single size (i.e., diameter). The flexible ribs 118 accommodate different sizes of bottles having different opening diameters. The dispenser 100 includes a relief tube 114 going up through the bottle 103 from the valve 108 to relieve any back air pressure, enabling a smooth flow from a nozzle 116 of the dispenser 100 when the valve 108 is actuated (i.e., in an open position). The dispenser 100 includes a touch valve mechanism. The touch valve includes a set of wings 112 protruding from the nozzle 116 of the dispenser 100. When the user moves the wings 112 from their initial position, the valve 108 releases fluid (e.g., water) from the bottle 103. This allows the user to actuate the valve 108 with a hand, or a wrist. When the user removes pressure from the wings 112, the valve 108 closes, preventing the fluid from flowing from the bottle 103 out the nozzle 116 of the dispenser 100. In one embodiment, the dispenser 100 includes lanyard attachment points 130 at the top of the bottle 103 and lanyard attachment points 132 at the bottom of the bottle 103. The purpose of the multiple lanyard connection points 130, 132 is to allow the user to carry the water bottle 103, via the lanyard 140 in either the right side up position or the upside down position. When using a lanyard 140, the user leans over and the bottle 103 is at the desired length of user's arms (i.e., the user can contact the wings 112 of the valve mechanism 108 with their wrist. Whenever the user moves the wings 112 relative to the nozzle 116, the wings 112 activate the touch valve mechanism 108 and release the water. If the user is walking and wants to make sure that the touch valve mechanism 108 does not get activated, they can attach the lanyard 140 to the top attachment point 130 (i.e., the lanyard attachment point 130 proximate the bottle opening) and the bottle 103 would stay right side up, preventing the release of fluid from the dispenser 100 (because gravity would be working against the dispenser 100 instead of driving the action thereof).

In one embodiment, the valve 108 is inside the tube 104 portion of the dispenser housing 110. The wings 112 are connected to the valve 108 via a stem 140 extending into the nozzle 116 and up the tube 104. In one embodiment, the valve 108 is a touch valve mechanism. The stem 140 extends through a diaphragm 142. The diaphragm seals against at least one rim 150 extending radially outward from the stem 140. When stem 140 is moved from the resting position, space is created between the diaphragm 142 and the rim 150 such that the liquid in the bottle 103 is allowed to flow from the bottle 103 into the tube 104, through the space created between the diaphragm 142 and the rim 150, and out the nozzle 116. Thus, whenever the wing 116 attached to the valve 108 via the stem 140 is moved relative to the nozzle from resting position of the wing, the valve 108 moves from the closed position to the open position. In one embodiment, the dispenser 100 further includes a relief tube 114 extending from the valve and the bottle 103 when the dispenser 100 is installed on the bottle 103. In one embodiment, the dispenser housing 110 is integral with the nozzle 116. In one embodiment, the seal 106 includes a flange 118 protruding radially from the tube 104. The flange 118 is configured to engage the bottle 103 when the dispenser 100 is installed on the bottle 103 (e.g., engage the mouth 400 of the bottle 103). In one embodiment, the seal 106 includes a plurality or series of flanges 118 extending radially from the tube 104. In one embodiment, at least one of the flanges 118 are formed of silicone. In one embodiment, the tube 104 has a shoulder 146 configured to limit a depth of insertion of the dispenser housing 110 and the hole in the bottle 103.

Referring to FIGS. 5-10, a second embodiment of a gravity driven dispenser 100 for a bottle 103 of liquid (e.g., water) is shown. In this embodiment, the bottle 103 remains in its upright position when the dispenser 100 is installed on the bottle 103 and in the upright position of the dispenser 100. The user may open the bottle cap (partially or fully) to allow air into the mouth 400 of the bottle 103 to relieve any back pressure caused by draining water from the bottle 103 via the dispenser 100. The dispenser 100 includes a retainer 504 (e.g., strap 504) that reaches around the bottle 103, securing the dispenser 100 to the bottle 103. A spring housing 512 of the dispenser 100 is attached to the retainer 504. The spring housing contains a spring 308 configured to bias the tube 104 toward the bottle 103. The tube 104 has serrations 304 at an end of the tube proximate the bottle 103. The tube 104 is configured to rotate with the nozzle insert 310. As the user rotates the nozzle insert 310, the spring 308 pushes the tube 104 toward the bottle 103, and the serrations 304 cut or puncture a hole in the bottle 103. Once the hole in the bottle 103 is formed, the spring 208 pushes the tube 104 into the bottle 103. A silicone or rubber gasket 306 surrounds the tube 104 and is set back from the serrated end 304 of the tube 104 such that the gasket 306 seals to the outside of the bottle 103 when the serrated end 304 of the tube 104 is pressed by the spring 308 into the bottle 103 through the hole cut by serrated end 304 of the tube 104. In one embodiment, the spring housing 512 includes a notch 514 configured to engage a corresponding key 516 of the nozzle insert 310 such that when the tube 104 punctures the bottle 103 and is inserted into the bottle 103, the nozzle insert 310 is prevented from rotating.

When the dispenser 100 is not in use (i.e., not on a bottle 103), the user may pull back on the nozzle insert 310 (i.e., away from the bottle 103) and turn the nozzle insert 310 90° to keep the tube 104 from sticking out of the spring housing 512. This enables the user to carry the dispenser 100 detached from the bottle 103 without fear of the serrated edge 304 of the tube 104 being exposed and causing unintended damage to items in contact with the dispenser 100.

When the serrated edge 304 (i.e., end) of the tube 104 is in the bottle 103, the tube 104 and nozzle insert 310 stay in a locked position using a key 516 on the nozzle insert 310 of the dispenser 100 and a notch 514 in the spring housing 512. This prevents the nozzle insert 310 from turning. To have the water flow out of the bottle 103, the user twists the nozzle cap 312 counterclockwise to start and increase the amount of water they want flowing out of the nozzle 116. The user twists the nozzle cap 312 clockwise to decrease the flow of water. In one embodiment, the nozzle 116 (e.g., nozzle cap 312) includes several holes that sprinkle the liquid from the nozzle in a wide area to get more coverage on the user's hands. When the user is finished washing their hands, they turn the nozzle cap 312 clockwise to decrease and cease the flow of water from the nozzle 116.

In one embodiment, the dispenser housing 110 and secures the dispenser 100 to the bottle 103 when the dispenser 100 is installed on the bottle 103. The tube 104 includes serrations 304 on an end of the 2104 configured to insert into the bottle 103 when the dispenser 100 is installed on the bottle 103. The seal 106 includes a gasket 306 disposed about the tube 104 and pressed against the bottle 103 by the tube 104 when the tube 104 is inserted into the bottle 103. The dispenser 100 further includes a spring 308 configured to bias the tube 104 toward the bottle 103 when the dispenser 100 is installed on the bottle 103. The dispenser 100 also includes a nozzle insert 310 connected to the tube 104. The nozzle insert 310 is configured to be rotatable by the user relative to the dispenser housing 110 in the tube 104 is configured to rotate with the nozzle insert 310 such that the separation's 304 of the tube 104 create the hole in the bottle 103 as the tube 104 is rotated. And nozzle 312 engages the tube 104 to create the valve 108. The nozzle 312 opens the valve 108 when rotated in a first direction (e.g. counterclockwise) and closes the valve 108 when rotated in a second direction opposite the first direction (e.g. clockwise). In one embodiment, the tube 104 extends along a longitudinal axis, and the nozzle insert 310 tube 104, and nozzle 312 have a common axis of rotation wherein the common axis of rotation is the longitudinal axis of the tube 104. In one embodiment, the dispenser housing 110 includes a strap 504 configured to reach around the bottle 103 and retain the dispenser housing 110 on the bottle 103 when the dispenser housing 110 is installed on the bottle 103. In one embodiment, the nozzle 312 includes a plurality of holes configured to disperse the liquid across a pattern having a width of at least a half an inch. In one embodiment, the dispenser housing 110 includes a spring housing 512 having a notch 514 at an end of the spring housing 512 adjacent the nozzle insert 310. The nozzle insert 310 includes a key 516 configured to engage the notch 514 when the tube 104 is inserted into the hole in the bottle 103. In one embodiment, the tube 104 includes a shoulder 518 configured to prevent the gasket 306 from moving along the tube 104 toward the nozzle 116 when the tube 104 is inserted into the bottle 103. In another embodiment, the gasket 306 is supported by the dispenser housing 110 and pressed against the side of the bottle 103 by the housing 110 when the housing 110 is installed on the bottle 103 such that even if the tube 104 is pulled back from the bottle 103 and the nozzle insert 310 is turned 90 degrees to prevent the tube from being pushed back into the bottle 103 by the spring 308, the liquid will not flow out of the bottle 103 because the gasket 306 and dispenser housing 110 cooperate to allow the liquid to fill a small portion of the dispenser housing 110 without allowing leaking between the bottle 103 side and the dispenser housing 110.

In one embodiment, the dispenser 100 includes a soap housing 604 for a disposable pod 606 made of foil or plastic. When a tab 608 is broken off the end of the pod 606 (e.g., the lower end) the user can squeeze the pod 606 in the center and release soap into the user's free hand. This pod 606 could be changed out when empty by inserting a new pod in the housing 604. In one embodiment, the 7 housing 604 includes a band extending around the bottle 103 and including lanyard attachment points 132. Alternatively, the pod 606 may include an attachment such as a hook and loop system for self adhering to the lanyard 140.

In another embodiment, the soap housing 604 for a disposable pod 606 of soap or sanitizer is part of the dispenser housing 110. In yet another embodiment, the pod housing 604 is a separate housing from the dispenser housing 110 including the spigot (i.e., nozzle 116) and valve 108, and the pod housing 604 attaches to the bottle 103 at the end opposite the housing 110 including the valve 108 and spigot 116 (see, for example, FIG. 1). In one embodiment, the dispenser 100 includes a lanyard attachment point 132 separate from the pod housing 604 and dispenser housing 110 including the spigot 116 and valve 108. The lanyard attachment point 132 attaches to the bottle 103 (e.g., secures around the bottle) at the end of the bottle 103 opposite the pod housing 604 to enable the user to secure the bottle 103 to the lanyard 140 in both the upright and upside down position of the bottle 103.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful HAND WASHING DISPENSER FOR A WATER BOTTLE it is not intended that such references be construed as limitations upon the scope of this invention except as set forth in the following claims.

What is claimed is:

1. A gravity based dispenser for a bottle, said dispenser comprising:

a nozzle configured to dispense a liquid from the bottle when receiving the liquid from the bottle;

a tube configured to insert into the bottle through a hole in the bottle and receive the liquid from the bottle;

a seal surrounding the tube, said seal configured to engage the bottle and prevent the liquid from flowing out of the bottle through the hole in any space between the tube and an edge of the hole;

a valve configured to selectively provide the liquid from the tube to the nozzle while in an open position and to prevent the liquid from flowing from the tube to the nozzle when in a closed position;

a dispenser housing supporting the nozzle, tube, seal, and valve the dispenser housing secures the dispenser to the bottle when the dispenser is installed on the bottle;

the tube comprises serrations on an end of the tube configured to insert into the bottle when the dispenser is installed on the bottle;

the seal comprises a gasket disposed about the tube and pressed against the bottle by the tube when the tube is inserted into the bottle;

the dispenser further comprises a spring configured to bias the tube toward the bottle when the dispenser is installed on the bottle;

the dispenser further comprises a nozzle insert connected to the tube, said nozzle insert configured to be rotatable by the user relative to the dispenser housing and the tube is configured to rotate with the nozzle insert such that the serrations of the tube create the hole in the bottle as the tube is rotated; and and a nozzle cap engaging the tube to create the valve, wherein the nozzle cap opens the valve when rotated in a first direction and closes the valve when rotated in a second direction opposite the first direction.

2. The dispenser of claim 1, wherein:

the tube extends along a longitudinal axis;

the nozzle insert, tube, and nozzle cap have a common axis of rotation; and the axis of rotation is the longitudinal axis of the tube.

3. The dispenser of claim 1, wherein the dispenser housing comprises a strap configured to reach around the bottle and retain the dispenser housing on the bottle when the dispenser housing is installed on the bottle.

4. The dispenser of claim 1, wherein the nozzle cap includes a plurality of holes configured to disperse the liquid across a pattern a having a width of at least ½ inch.

5. The dispenser of claim 1 wherein:

the dispenser housing comprises a spring housing having a notch at an end of the spring housing adjacent the nozzle insert; and the nozzle insert comprises a key configured to engage the notch when the tube is inserted into the hole in the bottle.

6. The dispenser of claim 1, wherein:

the tube comprises a shoulder configured to prevent the gasket from moving along the tube toward the nozzle when the tube is inserted into the bottle.

7. A gravity based dispenser for a bottle, said dispenser comprising:

a nozzle configured to dispense a liquid from the bottle when receiving the liquid from the bottle;

a tube configured to insert into the bottle through a hole in the bottle and receive the liquid from the bottle;

a seal surrounding the tube, said seal configured to engage the bottle and prevent the liquid from flowing out of the bottle through the hole in any space between the tube and an edge of the hole;

a valve configured to selectively provide the liquid from the tube to the nozzle while in an open position and to prevent the liquid from flowing from the tube to the nozzle when in the closed position;

a dispenser housing supporting the nozzle, tube, seal, and valve; wherein:

the dispenser housing secures the dispenser to the bottle when the dispenser is installed on the bottle;

the tube comprises serrations on an end of the tube configured to insert into the bottle when the dispenser is installed on the bottle;

the seal comprises a gasket pressed against the bottle by the tube when the dispenser is installed on the bottle and the tube is inserted into the bottle;

the dispenser further comprises a spring configured to bias the tube toward the bottle when the dispenser is installed on the bottle;

the dispenser further comprises a nozzle insert connected to the tube, said nozzle insert configured to be rotatable by the user relative to the dispenser housing wherein the tube is configured to rotate with the nozzle insert such that the serrations of the tube create the hole in the bottle as the tube is rotated; and the dispenser further comprises a nozzle cap engaging the tube to create the valve, wherein the nozzle cap opens the valve when rotated in a first direction and closes the valve when rotated in a second direction opposite the first direction.

* * * * *